US012768143B2

(12) United States Patent
Ishii et al.

(10) Patent No.: US 12,768,143 B2
(45) Date of Patent: Oct. 20, 2026

(54) ELECTRIC CONSTRUCTION MACHINE

(71) Applicant: Hitachi Construction Machinery Tierra Co., Ltd., Koka (JP)

(72) Inventors: Takeshi Ishii, Hino-cho (JP); Wataru Takagi, Kusatsu (JP); Hiroshi Kawaguchi, Konan (JP)

(73) Assignee: Hitachi Construction Machinery Tierra Co., Ltd., Koka (JP)

( * ) Notice: Subject to any disclaimer, the term of this patent is extended or adjusted under 35 U.S.C. 154(b) by 426 days.

(21) Appl. No.: 18/282,452

(22) PCT Filed: Jan. 7, 2022

(86) PCT No.: PCT/JP2022/000331
§ 371 (c)(1),
(2) Date: Sep. 15, 2023

(87) PCT Pub. No.: WO2022/201740
PCT Pub. Date: Sep. 29, 2022

(65) Prior Publication Data

US 2024/0159019 A1 May 16, 2024

(30) Foreign Application Priority Data

Mar. 22, 2021 (JP) ..... 2021-047603

(51) Int. Cl.
*E02F 9/24* (2006.01)
*E02F 9/20* (2006.01)
*E02F 9/22* (2006.01)

(52) U.S. Cl.
CPC ..... *E02F 9/24* (2013.01); *E02F 9/2095* (2013.01); *E02F 9/22* (2013.01)

(58) Field of Classification Search
CPC ..... E02F 3/435; E02F 3/325; E02F 9/2095; E02F 9/2033; E02F 9/22; E02F 9/24; E02F 9/26; E02F 9/267; E02F 9/268; E02F 9/207; E02F 9/0858; Y02T 10/70; Y02T 10/7072; Y02T 90/14; B60Y 2200/41; B60Y 2200/412
See application file for complete search history.

(56) References Cited

FOREIGN PATENT DOCUMENTS

CN 106480913 A 3/2017
CN 105926707 B 1/2018
(Continued)

OTHER PUBLICATIONS

English translation of JP-2008190231 (Year: 2008).*
(Continued)

*Primary Examiner* — Brandon Z Willis
(74) *Attorney, Agent, or Firm* — Crowell & Moring LLP

(57) ABSTRACT

A cable clamp (26) is disposed in an upper revolving structure (3) of a hydraulic excavator (1). The cable clamp (26) supports a power feeding cable (91) connected to a power feeding port (12A). The cable clamp (26) is supported on the upper revolving structure (3) via an arm member (23) attached on the upper revolving structure (3). A wire (30) is bridged over between the cable clamp (26) and the arm member (23). A tension sensor (29) detects a load applied to the wire (30). A controller (16) issues an alarm when a tension detection of the tension sensor (29) goes beyond a prescribed threshold value (T1 or T2).

6 Claims, 8 Drawing Sheets

(56) References Cited

FOREIGN PATENT DOCUMENTS

| | | | | |
|---|---|---|---|---|
| JP | 2008190231 | A | * | 8/2008 |
| JP | 2012-219461 | A | | 11/2012 |
| JP | 2017-14687 | A | | 1/2017 |
| JP | 2018-17011 | A | | 2/2018 |
| JP | 2018-145698 | A | | 9/2018 |

OTHER PUBLICATIONS

International Search Report (PCT/ISA/210) issued in PCT Application No. PCT/JP2022/000331 dated Mar. 8, 2022 with English translation (4 pages).
Japanese-language Written Opinion (PCT/ISA/237) issued in PCT Application No. PCT/JP2022/000331 dated Mar. 8, 2022 with English translation (6 pages).
Japanese-language International Preliminary Report on Patentability (PCT/IPEA/416 & PCT/IPEA/409) issued in PCT Application No. PCT/JP2022/000331 dated Feb. 28, 2023, including Annexes with partial English translation (13 pages).
European Office Action issued in European Application No. 22 774 545.2 dated Apr. 28, 2026 (4 pages).

* cited by examiner

ELECTRIC CONSTRUCTION MACHINE

TECHNICAL FIELD

The present invention relates to electric construction machines, such as an electric hydraulic excavator that is used in various working sites for civil engineering work, demolish work, underground work and the like, for example.

BACKGROUND ART

Most of construction machines represented by a hydraulic excavator use a diesel engine as a power source. The hydraulic excavator operates actuators (for example, hydraulic cylinders and hydraulic motors) by hydraulic oil supplied from a hydraulic pump connected to the diesel engine, thus executing a work of excavation and the like.

In general, a diesel engine that uses light oil as fuel emits exhaust gases containing particulate matter (PM), nitrogen oxides (NOx) more than a gasoline engine using gasoline as fuel. Therefore, for stepwise reducing the particulate matter and the nitrogen oxides contained in the exhaust gas, the legal regulation to the diesel engine has rapidly been in progress worldwide. From this background, there is a possibility that construction machines that do not emit the exhaust gas in the working site, that is, electric construction machines that use the electric power as the power source will be introduced a lot in the future.

As the electric construction machine, there is known an electric hydraulic excavator that supplies electric power to a vehicle body via a power feeding cable from an external power source of a distribution board disposed in a working site, for example.

The electric hydraulic excavator drives an electric motor by electric power supplied via a power feeding cable to operate a hydraulic pump connected to this electric motor. Here, for example, there will be considered a case of laying out the power feeding cable on the ground from the external power source to the electric hydraulic excavator. In this case, the power feeding cable is possibly stepped on following a traveling movement of the electric hydraulic excavator or the power feeding cable is possibly entangled following a revolving movement of the upper revolving structure.

Therefore, when the electric hydraulic excavator is caused to be moved without the limitation, the power feeding cable or a power feeding port for the connection of the power feeding cable is possibly damaged. That is, the electric hydraulic excavator that operates in a state of connecting the power feeding cable is required to limit the revolving movement and the traveling movement or suppress an overload from being applied to the power feeding cable for protecting equipment devices regarding the power feeding. On the other hand, Patent Document 1 describes an automotive construction machine configured to supply electric power to the vehicle body via a power feeding cable hanging down from the ceiling. The automotive construction machine according to Patent Document 1, when the tension of the power feeding cable detected by a road limiter goes beyond a threshold value, prohibits the traveling movement or the revolving movement in the operation direction at this time and allows the traveling movement or the revolving movement in the opposing direction to the operation direction at this time.

PRIOR ART DOCUMENT

Patent Document

Patent Document 1: Japanese Patent Laid-Open No. 2012-219461 A

SUMMARY OF THE INVENTION

The automotive construction machine according to Patent Document 1 is provided with the load limiter between a trolley moving along a rail of the ceiling at the working site and the power feeding cable. However, there are many cases where an installation position, a laying-out situation and a pulling method of the power feeding cable, a length of the power feeding cable from the load limiter to the automotive construction machine, and the like are respectively different depending upon the operating site. Therefore, in a case of the technology by Patent Document 1, a tension detection value of the load limiter, a threshold value to be used for control or the like are required to be corrected (adjusted) depending upon the operating site at that time and that work is troublesome.

An object of the present invention is to provide an electric construction machine that can reduce the time required to adjust an overload detecting device of a power feeding cable in accordance with an operating site.

The electric construction machine according to the present invention including an automotive vehicle body and a working mechanism attached to the vehicle body, the vehicle body being provided with a power feeding port for connection of a power feeding cable that supplies electric power to a power source, where the electric construction machine further comprising a cable support member that is disposed in the vehicle body to support the power feeding cable connected to the power feeding port, a load detecting sensor for detecting a state quantity corresponding to a load applied to the cable support member from the power feeding cable, and a controller configured to issue an alarm when a detection value of the load detecting sensor goes beyond a prescribed threshold value.

According to the present invention, the time required to adjust an overload detecting device of a power feeding cable in accordance with an operating site can be reduced.

MODE FOR CARRYING OUT THE INVENTION

Hereinafter, an embodiment of the present invention will be in detail explained referring to the accompanying drawings by taking a case of being applied to an electric hydraulic excavator representative of an electric construction machine as an example.

Figure 8:
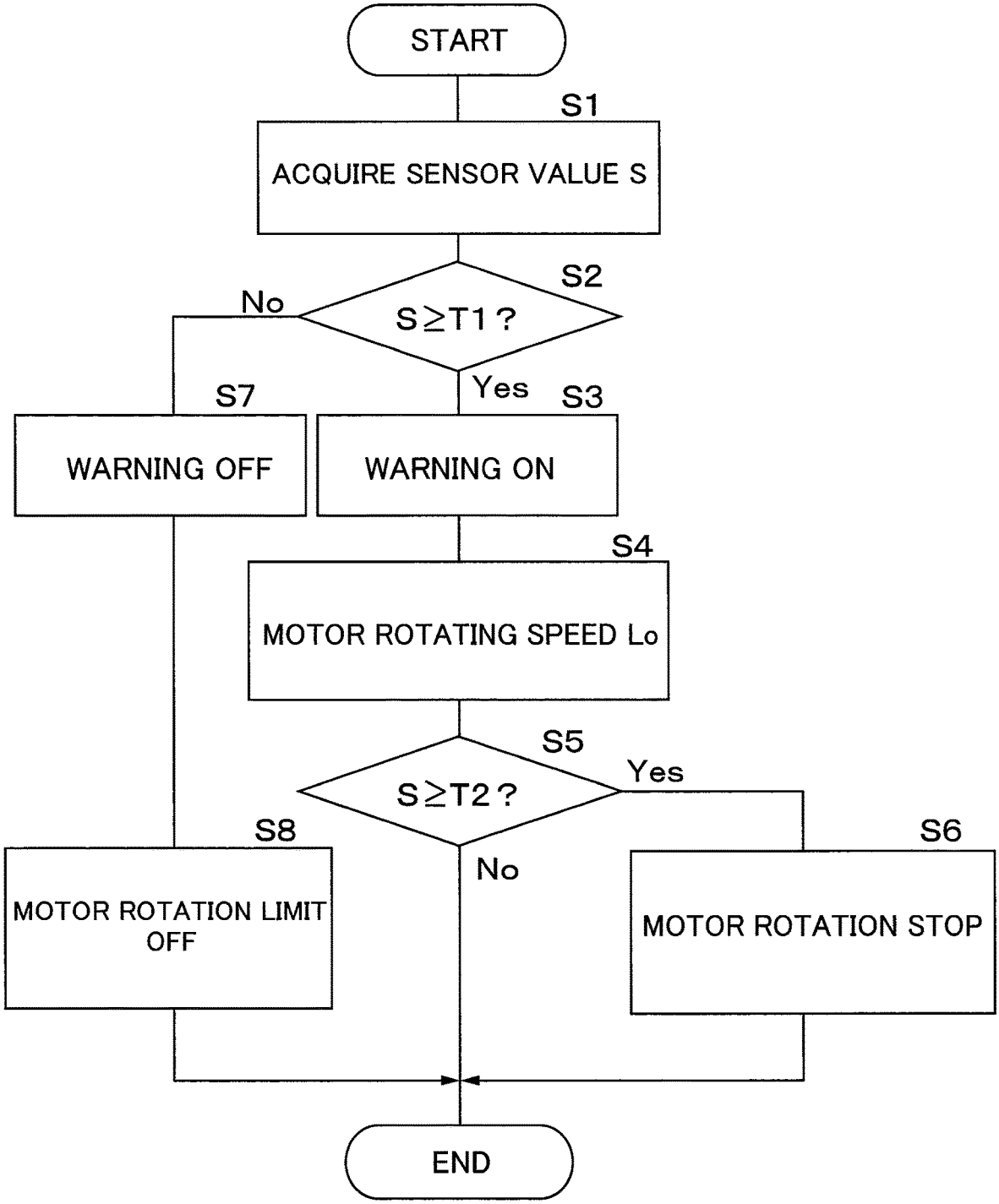
FIG. 8 is a flow chart view showing the processing by a controller in FIG. 7.

It should be noted that in the following explanation, the front side of a front-rear direction of an electric hydraulic excavator 1 is defined as a working mechanism 4-side and the rear side thereof is defined as a counterweight 7-side at the opposite side to the working mechanism 4. A left-right direction of the electric hydraulic excavator 1 is defined as a direction perpendicular to the front-rear direction. For example, in FIG. 1, a left-right direction of paper corresponds to the front-rear direction (X direction) of the electric hydraulic excavator 1, a front-back direction of paper corresponds to the left-right direction (Y direction) of the electric hydraulic excavator 1, and an upper-lower direction of paper corresponds to an upper-lower direction (Z direction) of the electric hydraulic excavator 1. In addition, each step in the flowchart as shown in FIG. 8 uses notation of "S" (for example, step 1="S1").

The electric hydraulic excavator 1 (hereinafter, referred to as a hydraulic excavator 1) as the electric construction machine is used in working sites for civil engineering works, demolish works, underground works and the like, for example. The hydraulic excavator 1 according to the embodiment is configured as a hydraulic excavator (electric mini excavator or electric compact hydraulic excavator) of a compact type (for example, the machinery weight is approximately one to six tons) suitable for works in a narrow working site for underground works, for example, and the like. In addition, the hydraulic excavator 1 according to the embodiment is configured as the hydraulic excavator 1 of a cab specification.

The electric hydraulic excavator 1 is provided with an automotive lower traveling structure 2 of a crawler type, an upper revolving structure 3 mounted on the lower traveling structure 2 to be capable of revolving thereto and a working mechanism 4 disposed on the upper revolving structure 3. A vehicle body of the electric hydraulic excavator 1 includes the lower traveling structure 2 and the upper revolving structure 3. The vehicle body can travel and revolve. The swing type working mechanism 4 is disposed to be capable of swinging on the front side of the upper revolving structure 3. The hydraulic excavator 1 uses the working mechanism 4 to carry out an excavating work of earth and sand or the like.

The lower traveling structure 2 is configured of a crawler track 2A with a plurality of shoes attached to an endless-shaped track link, and left and right traveling hydraulic motors (not shown) that revolve the crawler track 2A to cause the hydraulic excavator 1 to travel (travel on its own). A revolving device configured of a revolving bearing and a revolving hydraulic motor is disposed between the lower traveling structure 2 and the upper revolving structure 3.

The working mechanism 4 also called a front device is provided with a swing post 4A disposed on the front side of a revolving frame 5 to be capable of swinging in the left-right direction. A boom 4B is attached on the swing post 4A to be rotatable thereto, and an arm 4C is attached on a tip end of the boom 4B to be rotatable thereto. A bucket 4D as a working tool is attached on a tip end of the arm 4C to be rotatable thereto. In addition, the working mechanism 4 is provided with a swing cylinder 4E for swinging the swing post 4A, a boom cylinder 4F for rotating the boom 4B, an arm cylinder 4G for rotating the arm 4C, and a bucket cylinder 4H as a working tool cylinder for rotating the bucket 4D.

The upper revolving structure 3 revolves on the lower traveling structure 2 by the driving of the revolving hydraulic motor in the revolving device. The upper revolving structure 3 is provided with the revolving frame 5 as a support structure (base frame). The revolving frame 5 is provided thereon with a cab 6, the counterweight 7, an exterior cover 8, an electric motor 9, a hydraulic pump 10, a battery device 11, a control valve device (not shown) and the like. In this case, the working mechanism 4 is attached on front side of the revolving frame 5. The counterweight 7 is attached on the rear side of the revolving frame 5.

The cab 6 is disposed on the left side of the revolving frame 5. The cab 6 is formed in a boxy shape to be surrounded by a front surface 6A, a rear surface 6B, a left side surface 6C, a right side surface 6D and an upper surface 6E. The inside of the cab 6 is formed as an operating room for an operator. An operator's seat for the operator to sit on, a traveling lever and pedal for controlling the hydraulic excavator 1 and a working lever are arranged in the cab 6. The operator operates the traveling lever and pedal and the working lever, thereby making it possible to carry out the travel by the lower traveling structure 2, the revolving of the upper revolving structure 3, the excavation by the working mechanism 4 and the like.

The counterweight 7 is positioned closer to the rear side than the cab 6 to be disposed in the rear end of the revolving frame 5 for acting as a weight balance to the working mechanism 4. The counterweight 7 extends in the left-right direction and is formed as an arc-shaped heavy load of which a central part in the left-right direction projects backward. Thereby, when the upper revolving structure 3 revolves, a rear surface 7A of the counterweight 7 is formed as an arc surface in such a manner as to be accommodated within a visual circle having a constant revolving radius.

The counterweight 7 rises upward from the rear end of the revolving frame 5 to cover the battery device 11 and the like from the backward. An extension part 7B is formed on an upper end of the counterweight 7 to extend forward, and the rear side of the cab 6 is supported by the extension part 7B. In addition, a power receiving box 12 is disposed on the left end side of the extension part 7B. A cable support device 21 is disposed on the right end side of the extension part 7B. A power feeding cable 91 gripped by the cable support device 21 is connected to the power receiving box 12.

Figure 1:
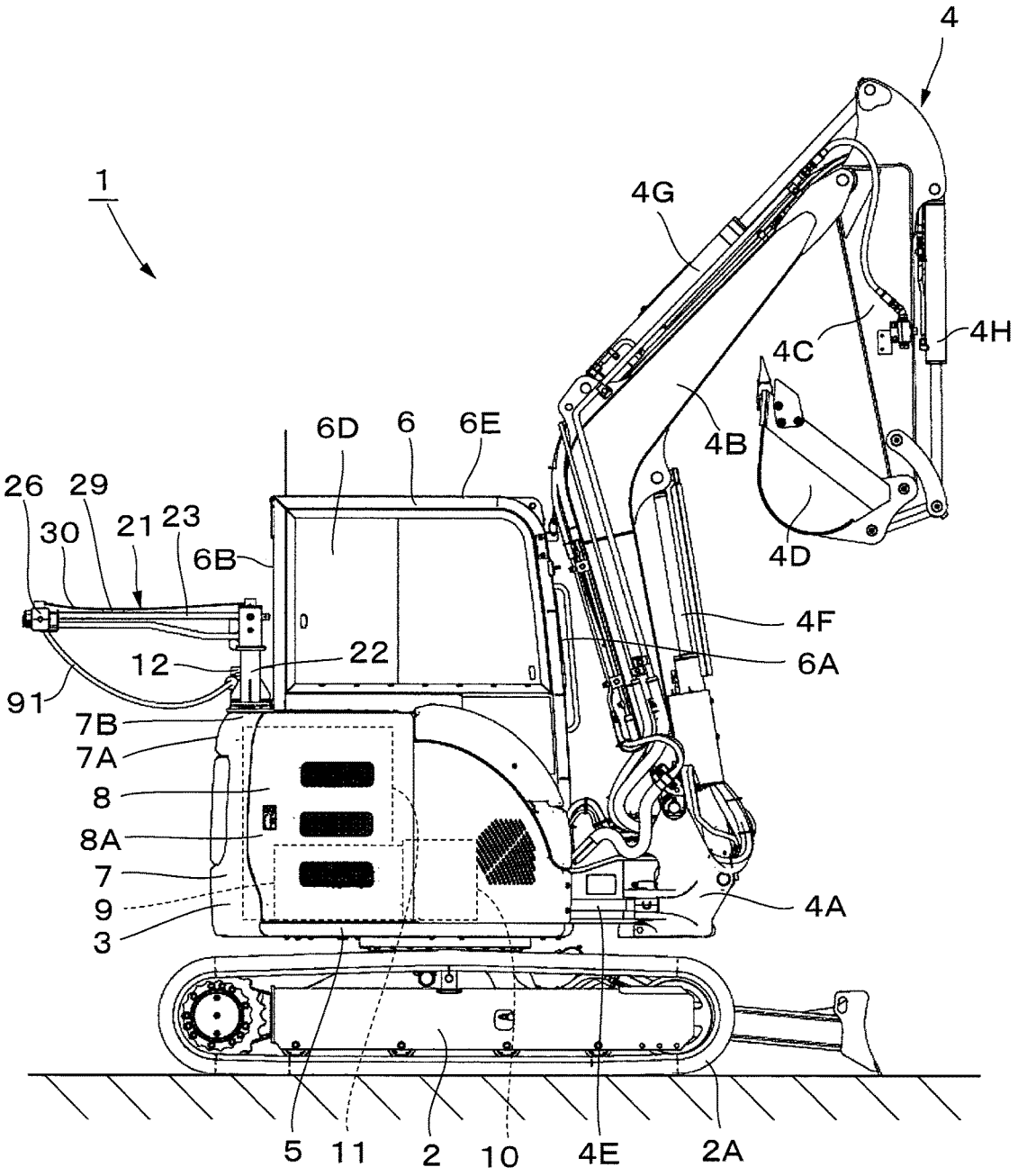
FIG. 1 is a right side view showing an electric hydraulic excavator according to an embodiment in a state where a power feeding cable is connected to a power feeding port of an upper revolving structure.
Figure 2:
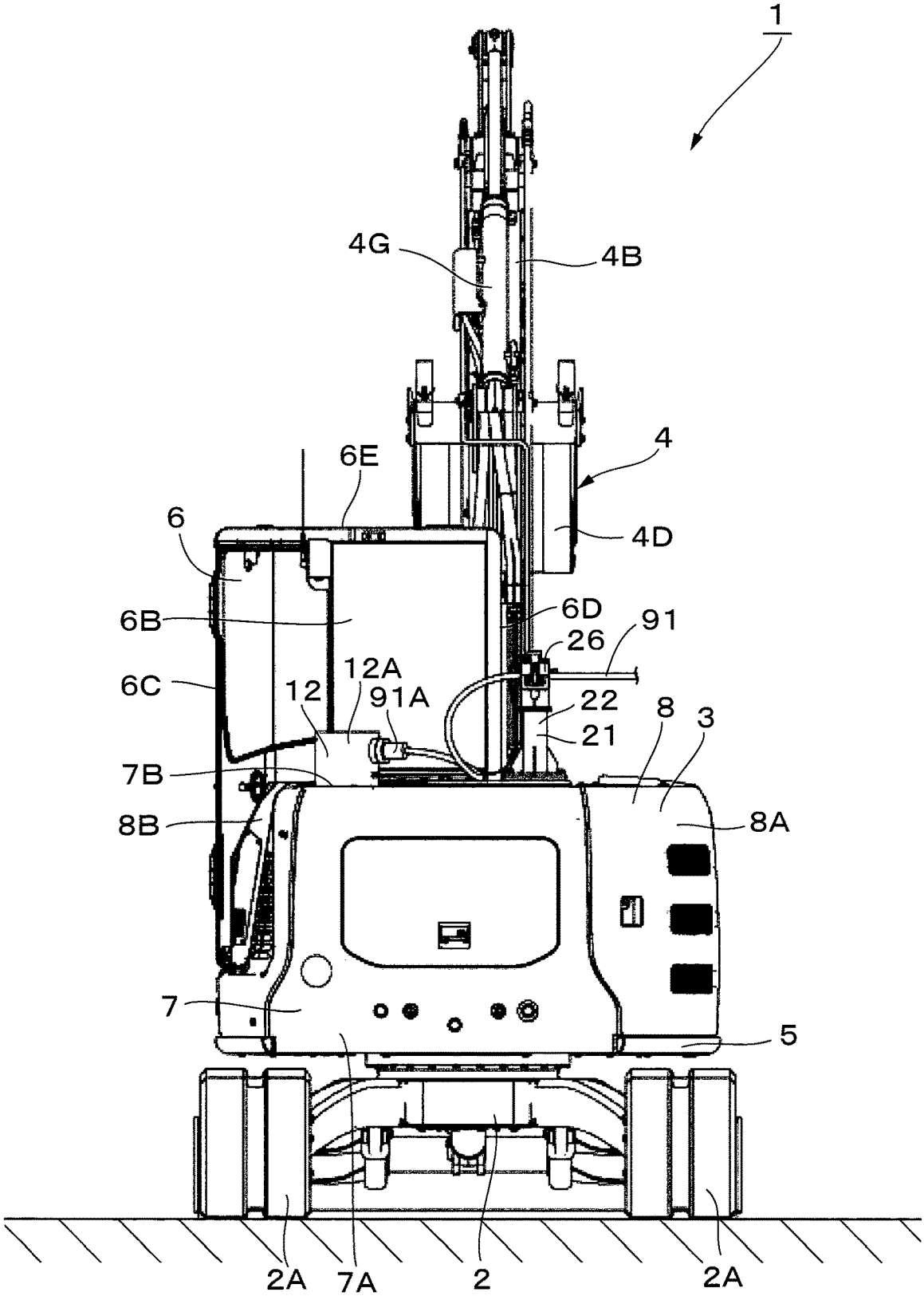
FIG. 2 is a rear view showing the electric hydraulic excavator as viewed from the left side in FIG. 1.

The exterior cover 8 is positioned in front of the counterweight 7 and is disposed on the revolving frame 5. As shown in FIG. 1, the exterior cover 8 covers the electric motor 9, the hydraulic pump 10, the battery device 11 and the like together with the counterweight 7. The exterior cover 8 includes a right exterior cover 8A for covering the electric motor 9, the hydraulic pump 10, the battery device 11 and the like from the right side and the upper side, and a left exterior cover 8B for covering the battery device 11 and the like from the left side.

Figure 3:
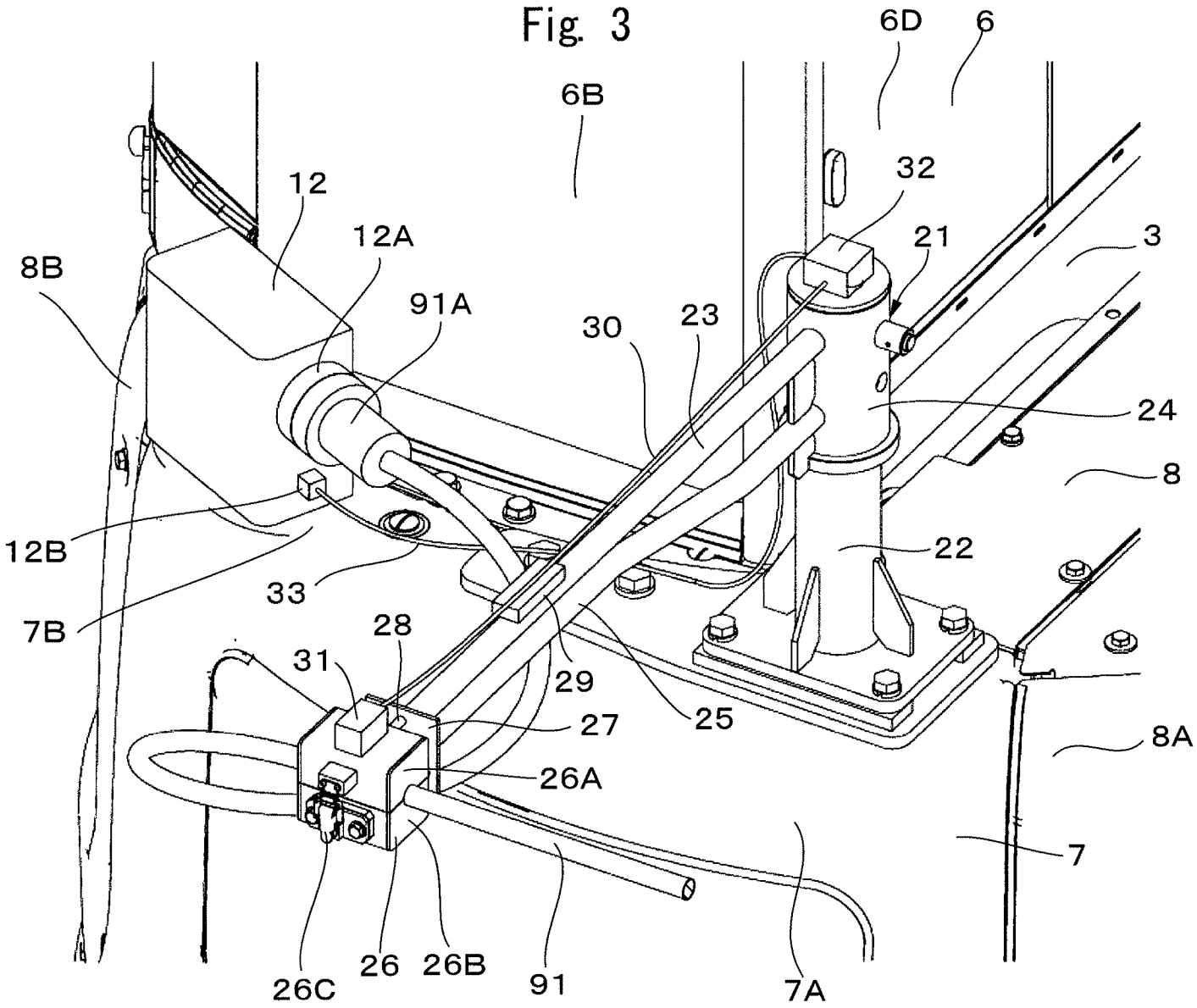
FIG. 3 is a perspective view showing a cab, a counterweight, a cable support device, a power receiving box, the power feeding cable, and the like in an enlarging manner.
Figure 4:
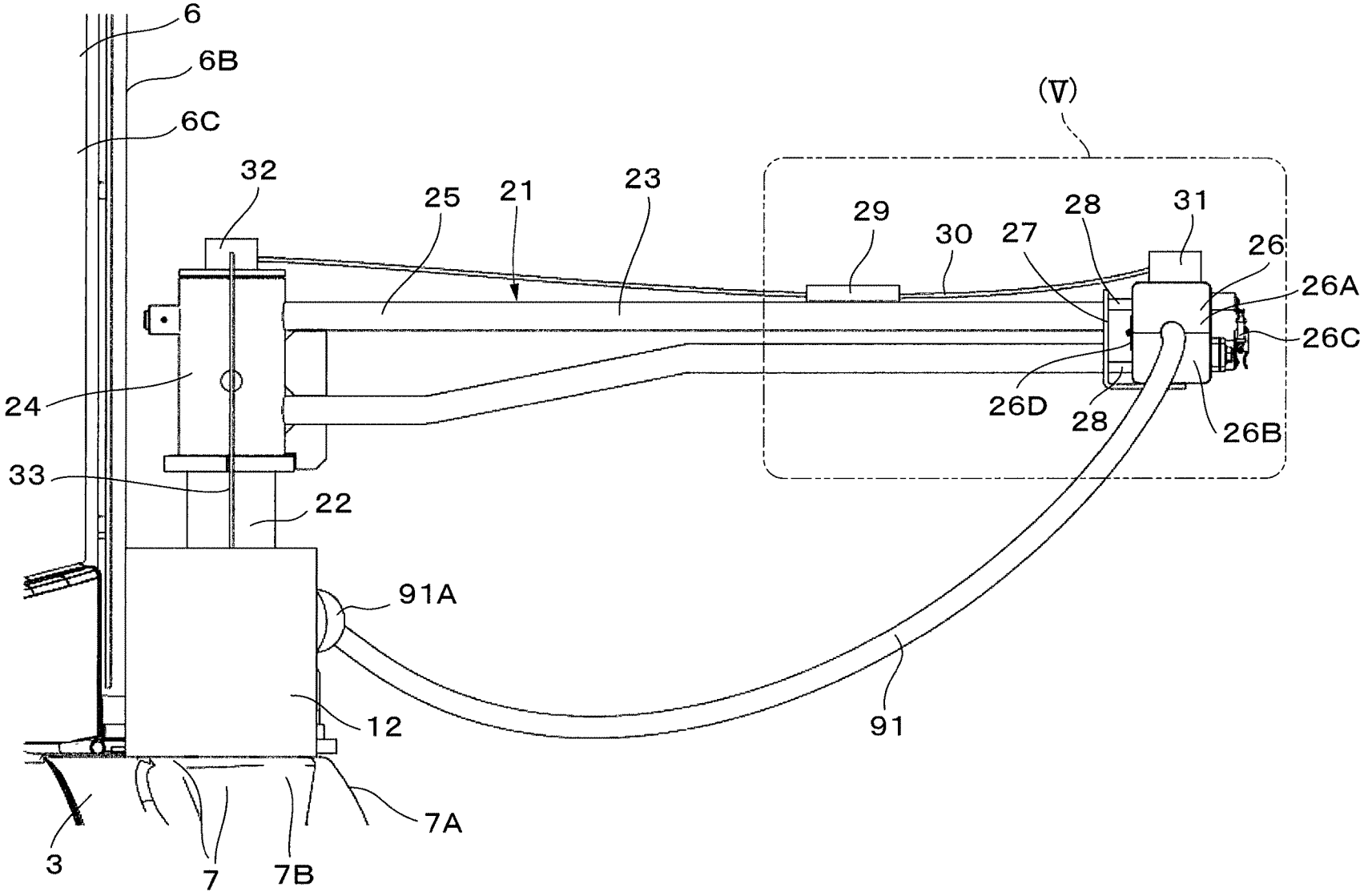
FIG. 4 is a left side view showing the cab, the counterweight, the cable support device, the power receiving box, the power feeding cable, and the like in an enlarging manner.

As shown in FIG. 3, the power receiving box 12 is disposed on the left end side of the extension part 7B in the counterweight 7. The power receiving box 12 is provided with a power feeding port 12A (for example, an inlet as a female-side connector) for connection of the power feeding cable 91. A power feeding connector 91A (for example, an inlet plug as a male-side connector) of the power feeding cable 91 extending from an external power source 92 (FIG.

7) is connected to the power feeding port 12A. In this way, the upper revolving structure 3 is provided with the power feeding port 12A for connection of the power feeding cable 91. The power feeding cable 91 supplied electric power to the electric motor 9 as the power source. A signal connector 12B is disposed in the power receiving box 12 to be positioned in the lower side to the power feeding port 12A. A signal cable 33 for connection between a tension sensor 29 and a controller 16, which will be described later, is connected to the signal connector 12B.

Figure 7:
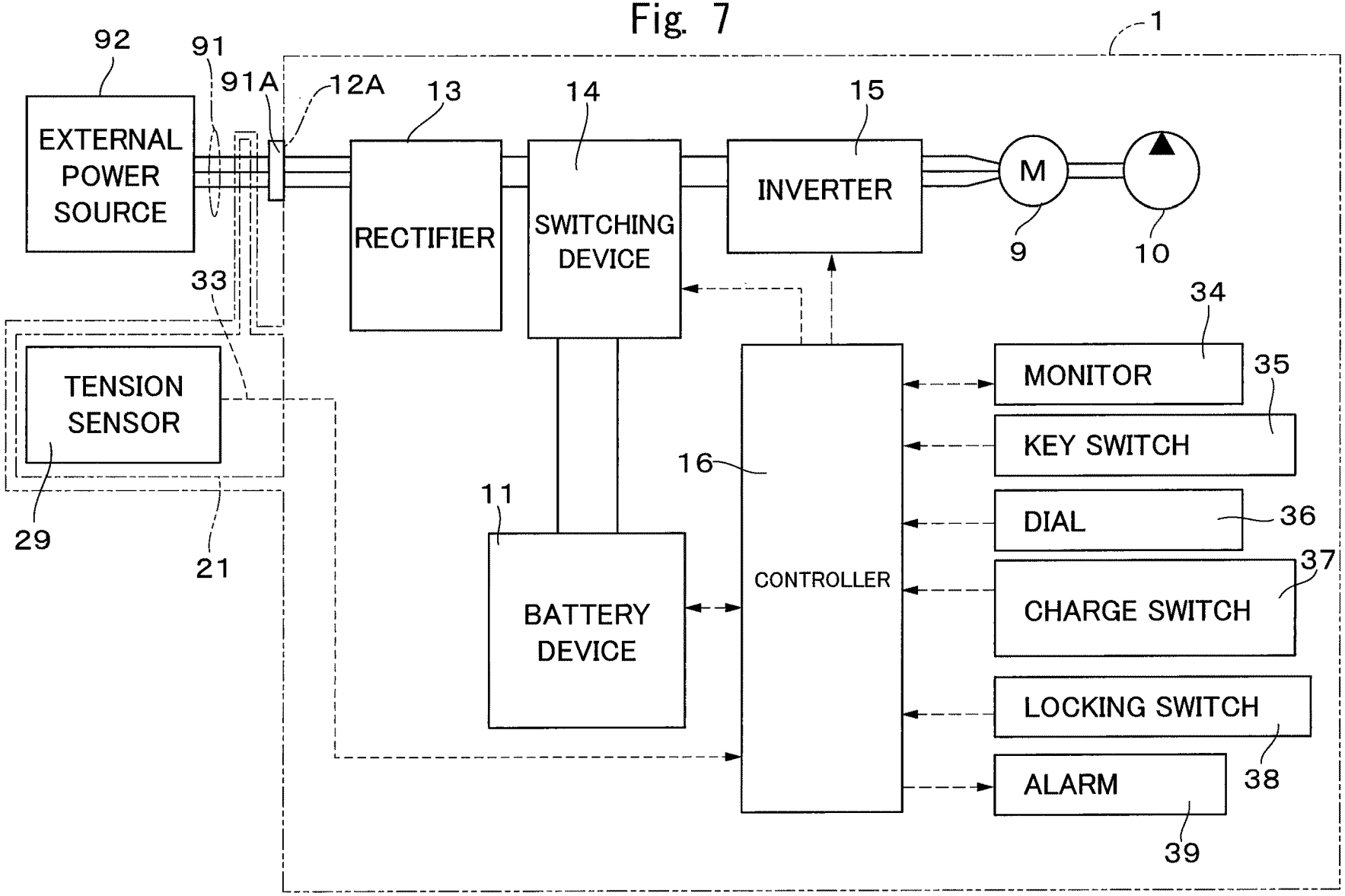
FIG. 7 is a circuit construction view showing an electric drive system for driving a hydraulic pump in the electric hydraulic excavator.

The exterior cover 8 is provided therein with a rectifier 13, a switching device 14, an inverter 15 and the controller 16, which are shown in FIG. 7, as described later besides the electric motor 9, the hydraulic pump 10 and the battery device 11. The rectifier 13 converts AC power supplied from the external power source 92 into DC power. The switching device 14 switches a supplying state of electric power between the rectifier 13, the battery device 11 and the inverter 15. The inverter 15 converts DC power supplied from the switching device 14 into AC power, which is supplied to the electric motor 9. As shown in FIG. 7, the power feeding port 12A, the rectifier 13, the switching device 14, the battery device 11, the inverter 15 and the electric motor 9 are respectively connected to be capable of being energized by in-vehicle cables.

The electric motor 9 is a power source of the hydraulic excavator 1. The electric motor 9 is connected mechanically to the hydraulic pump 10, that is, to be capable of transmitting the electric power (rotation). The hydraulic pump 10 supplies hydraulic oil via the control valve device to various kinds of hydraulic actuators (hydraulic cylinders and hydraulic motors) of the boom cylinder 4F and the like. The control valve device is a group of control valves composed of a plurality of directional control valves. The control valve device distributes the hydraulic oil discharged from the hydraulic pump 10 to the plurality of hydraulic actuators (hydraulic cylinders and hydraulic motors) of the boom cylinder 4F and the like in response to operations of the traveling lever and pedal and the working lever. Thereby, the hydraulic excavator 1 can perform traveling, revolving and excavating movements, and the like.

The hydraulic excavator 1 can operate in a state where the power feeding connector 91A of the power feeding cable 91 is removed from the power feeding port 12A of the power receiving box 12 and the power feeding cable 91 is removed from the cable support device 21 when the battery device 11 is sufficiently charged, for example. In this case, the electric motor 9 is driven by the electric power from the battery device 11. In addition, the hydraulic excavator 1 can operate in a state where the power feeding connector 91A of the power feeding cable 91 is connected to the power feeding port 12A of the power receiving box 12 and the power feeding cable 91 is attached to the cable support device 21. In this case, the electric motor 9 is driven by the electric power from the external power source 92 and the electric power from the battery device 11 for making up a deficiency.

When the power feeding cable 91 is connected to the power feeding port 12A, the hydraulic excavator 1 can perform the traveling, revolving and excavating movements and the like in this connected state. At this time, the middle part of the power feeding cable 91 connected to the power feeding port 12A is supported by the cable support device 21. That is, the power feeding cable 91 supported by the cable support device 21 is connected to the power feeding port 12A of the power receiving box 12. The cable support device 21 also called a cable stand is provided with a shaft member 22 and an arm member 23.

The shaft member 22 is attached on the upper revolving structure 3 (an upper surface of the counterweight 7) in a state where a shaft center thereof is extending in the upper-lower direction. The arm member 23 is attached on the shaft member 22 to be capable of rotating centering on the shaft center of the shaft member 22 in the upper-lower direction. The arm member 23 includes a bottomed cylindrical part 24 fitting in the shaft member 22 to be rotatable therein and a rod part 25 extending in a horizontal direction from the bottomed cylindrical part 24. A cable clamp 26 is disposed on the tip end side of the arm member 23, that is, on the tip end side of the rod part 25 to grip the power feeding cable 91.

The arm member 23 can be fixed to the shaft member 22 in a plurality of positions in the rotating direction by an unillustrated locking mechanism. For example, the arm member 23 is fixed in a cable gripping position as shown in FIG. 1 to FIG. 6. In addition, the illustration is omitted, but the arm member 23 is fixed in a cab-lateral storage position of being arranged along the right side surface 6D of the cab 6. In addition, the illustration is omitted, but the arm member 23 is fixed in a cab-backward storage position of being arranged along the rear surface 6B of the cab 6. The arm member 23 is selectively fixed in any one of three positions of the cable gripping position, the cab-lateral storage position and the cab-backward storage position.

When the hydraulic excavator 1 performs the working in a state where the power feeding cable 91 is connected to the power feeding port 12A, the arm member 23 is fixed in the cable gripping position as shown in FIG. 1 to FIG. 6. That is, the arm member 23 is fixed in a position where a tip end side of the arm member 23 (rod part 25) extends from the upper revolving structure 3 (the rear surface 7A of the counterweight 7). Thereby, at the revolving time of the hydraulic excavator 1, the rolling-in of the power feeding cable 91 can be suppressed and at the traveling time of the hydraulic excavator 1, the stepping-on of the power feeding cable 91 can be suppressed.

Figure 5:
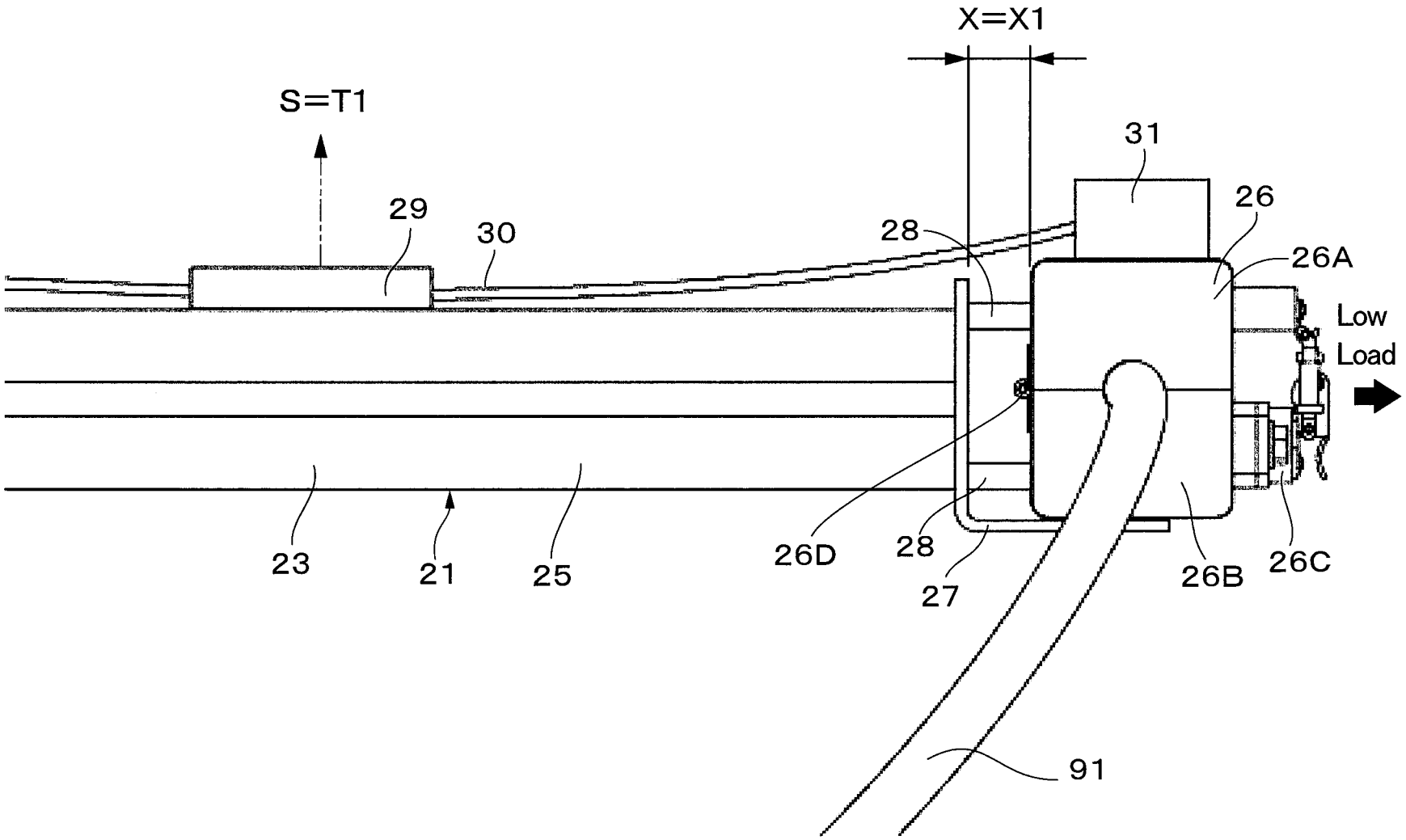
FIG. 5 is an enlarged view showing (V) part in FIG. 4.
Figure 6:
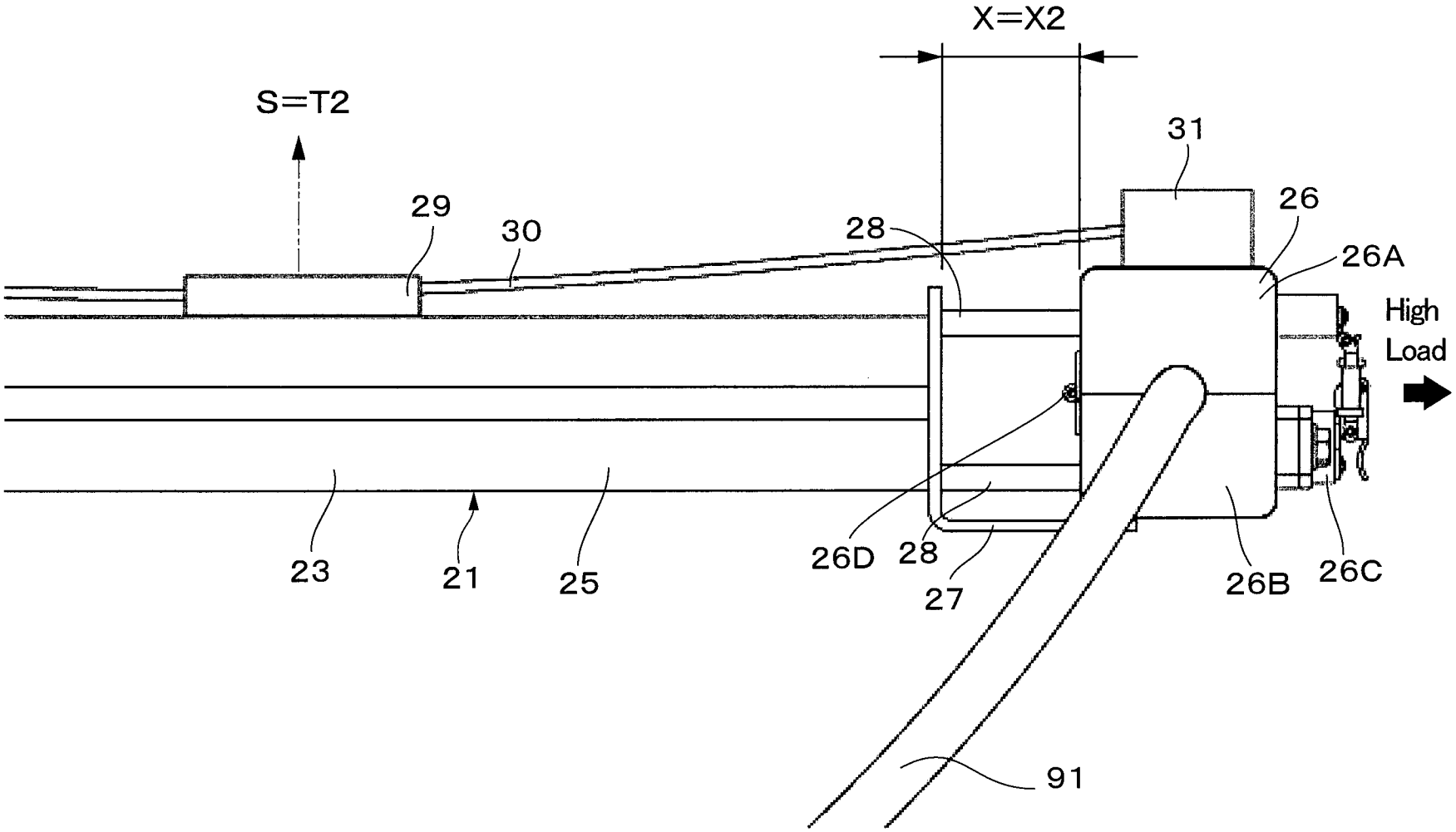
FIG. 6 is an enlarged view showing, in the same position as in FIG. 5, a state where a cable clamp (cable support member) is displaced in a direction away from an arm member (vehicle body-side support member).

The cable clamp 26 and the like are shown in an enlarging manner in FIG. 5 and FIG. 6. The cable clamp 26 is provided with a pair of clamp members 26A, 26B to be capable of opening/closing by a hinge mechanism 26D, and a lock 26C for fixing the clamp members 26A, 26B in a closed state. The pair of clamp members 26A, 26B are opened/closed on a basis of the hinge mechanism 26D between in a closing position of putting the power feeding cable 91 therebetween for the gripping from the outer peripheral side and in an opening position of releasing the power feeding cable 91. The lock 26C locks the pair of clamp members 26A, 26B to be fixed in the closing position where the middle part of the power feeding cable 91 is gripped.

As shown in FIG. 3, the power feeding cable 91 is gripped by the cable clamp 26 at the tip end of the arm member 23 (rod part 25) extending horizontally from the shaft member 22 of the cable support device 21. In this state, the power feeding connector 91A as an end part of the power feeding cable 91 is connected to the power feeding port 12A of the power receiving box 12. The electric power of the external power source 92 is supplied via the power feeding cable 91, the power feeding connector 91A and the power feeding port 12A of the power receiving box 12 to the hydraulic excavator 1.

The cable clamp 26 is supported on a bracket 27 disposed on a tip end side of the arm member 23 (rod part 25). In this case, the cable clamp 26 is attached to the bracket 27 to be capable of being displaced thereto in a prescribed direction (for example, in a left-right direction in FIG. 4 to FIG. 6) via a spring member 28 as an elastic member and an unillustrated guide member. In addition, the tension sensor 29 as a load detecting sensor is disposed on the arm member 23 (rod part 25) of the cable support device 21. The tension sensor 29 detects tension S applied to a wire 30.

The wire 30 is bridged over between a clamp-side wire support portion 31 fixed to the cable clamp 26 and a vehicle body-side wire support portion 32 fixed to the arm member 23 (more specifically, the bottomed cylindrical part 24). Thereby, the wire 30 is fixed to both of the cable clamp 26 as the power feeding cable 91-side and the arm member 23 (bottomed cylindrical part 24) as the vehicle body side.

The wire 30 varies in tension in response to a displacement of the cable clamp 26 to the arm member 23 (rod part 25). That is, the tension of the wire 30 gets the larger as the cable clamp 26 is the more displaced in a direction (to the right side in the left-right direction in FIG. 4 to FIG. 6) away from the arm member 23 (rod part 25). In other words, the tension of the wire 30 gets the larger as the cable clamp 26 is the more displaced in a direction away from the vehicle body. The tension sensor 29 detects a tension of the wire 30 changing (tensing or relaxing) in response to the displacement of the cable clamp 26. Thereby, the tension sensor 29 can detect a load applied to the cable clamp 26, and consequently, a load applied to the power feeding cable 91.

That is, the tension sensor 29 detects a displacement quality of the cable clamp 26 corresponding to the load applied to the power feeding cable 91 as a tension applied to the wire 30. The tension sensor 29 is connected via the signal cable 33 to the controller 16. The tension sensor 29 outputs a signal (tension signal) corresponding to the detected tension to the controller 16. As shown in FIG. 3, the signal cable 33 extending from the tension sensor 29 to the controller 16 is arranged (introduced) in the upper revolving structure 3 via the signal connector 12B of the power receiving box 12 from the vehicle body-side wire support portion 32 fixed to the arm member 23 (bottomed cylindrical part 24). The wire 30, the tension sensor 29 and the controller 16 configure a cable load detecting device (an overload detecting device) for detecting a load of the power feeding cable 91.

The spring member 28 and the guide member are arranged between the cable clamp 26 and the bracket 27 fixed to the arm member 23 (rod part 25). The guide member guides the cable clamp 26 to the bracket 27 (rod part 25). That is, the guide member regulates the displacement of the cable clamp 26 to be a straight displacement (left-right direction in FIG. 4 to FIG. 6) as one direction (direction where the rod part 25 extends) to the bracket 27. The guide member may include, for example, a convex rail (linear member) disposed in the bracket 27 and a recessed portion that is disposed in the cable clamp 26 and is engaged with the rail of the bracket 27.

The spring member 28 expands/contracts in response to a displacement of the cable clamp 26. At the operating time of the hydraulic excavator 1, the cable clamp 26 is displaced in the left-right direction in FIG. 4 to FIG. 6 in response to a load applied to the power feeding cable 91 to cause the spring member 28 to expand/contract. For example, when the cable clamp 26 is displaced to the right side (side away from the vehicle body) as shown in FIG. 6, the wire 30 is tensioned to make a detection value of the tension sensor 29 large. In reverse to this, when the cable clamp 26 is displaced to the left side (side closer to the vehicle body) as shown in FIG. 5, the wire 30 is relaxed to make a detection value of the tension sensor 29 small.

Next, an explanation will be made of an electric drive system of the hydraulic excavator 1 by referring to FIG. 7.

As shown in FIG. 7, the electric power is supplied via the power feeding cable 91 from the external power source 92 of a commercial power source arranged in a position away from the hydraulic excavator 1 or the like to the electric drive system of the hydraulic excavator 1. The electric drive system of the hydraulic excavator 1 is provided with a function (charging function) for supplying the electric power to the battery device 11 from the external power source 92 and a function (driving function) for supplying the electric power to the electric motor 9 from the external power source 92 and/or the battery device 11. The electric power supply (charging) to the battery device 11 and the electric power supply to the inverter 15 are carried out by connecting a relay disposed in an internal circuit of the switching device 14 based upon a command from the controller 16.

The external power source 92 is three-phase AC power, for example. The rectifier 13 converts the three-phase AC power into DC power. At the time of connecting the power feeding connector 91A of the power feeding cable 91 to the power feeding port 12A of the power receiving box 12, the electric power of the external power source 92 can be supplied via the power feeding cable 91 and the power feeding port 12A to the hydraulic excavator 1. In this case, the electric power of the external power source 92 can be supplied (charged) via the power feeding cable 91, the power feeding port 12A, the rectifier 13 and the switching device 14 to the battery device 11. In addition, the electric power of the external power source 92 can be supplied via the power feeding cable 91, the power feeding port 12A, the rectifier 13 and the switching device 14 and the inverter 15 to the electric motor 9. In addition, the electric power of the battery device 11 can be supplied via the switching device 14 and the inverter 15 to the electric motor 9.

An input side of the controller 16 is connected to the tension sensor 29, a monitoring device 34, a key switch 35, a rotating speed dial 36, a charge switch 37, a locking switch 38 and the battery device 11. An output side of the controller 16 is connected to the monitoring device 34, an alarm 39, the battery device 11, the switching device 14 and the inverter 15. The controller 16 is a vehicle body control controller for controlling the movement of the hydraulic excavator 1. The controller 16 controls the switching device 14 and the inverter 15 based upon signals (input signals) from the key switch 35, the rotating speed dial 36, the locking switch 38, the charge switch 37, the monitoring device 34, the tension sensor 29 and the battery device 11. Thereby, the controller 16 controls a drive of the electric motor 9 as a drive source of the hydraulic excavator 1.

In addition, the controller 16 executes control (information display control) of the monitoring device 34 and control (alarm output control) of the alarm. Further, the controller 16 executes necessary control (alarm) in response to a detection value (tension) detected by the tension sensor 29. For these controls, the controller 16 includes a microcomputer. The controller 16 is provided with a memory composed of a flash memory, a ROM, a RAM, an EEPROM and the like, and a calculation circuit (CPU). A control program for giving necessary alarm in response to a detection value (tension) of the tension sensor 29, that is, a process program for executing a process flow as shown in FIG. 8 to be described later is stored in the memory.

A battery monitoring device is disposed in the battery device 11. The controller 16 is connected to the battery monitoring device. The battery monitoring device monitors a state of the battery device 11 (battery state), for example, an SOC (charging state), temperatures, abnormality and the like. The battery monitoring device outputs a signal corresponding to the battery state to the controller 16.

The monitoring device 34 is an in-vehicle monitor (monitor). The monitoring device 34 is disposed in the cab 6 of the hydraulic excavator 1, for example. The monitoring device 34 displays information that should be conveyed to an operator for steering the hydraulic excavator 1. For example, the monitoring device 34 displays the operating state of the hydraulic excavator 1, the SOC corresponding to a battery remaining quantity of the battery device 11, malfunction information on various equipment devices, warning information, the present time and the like. The monitoring device 34 is an information alarm device for alarming information to an operator by using a screen.

The key switch 35 is disposed in the cab 6 of the hydraulic excavator 1, for example. The key switch 35 is a start-up stop switch for executing start-up (power source ON) and stop (power source OFF) of the hydraulic excavator 1. Signals (ON signal and OFF signal) of the key switch 35 are outputted to the controller 16. An operator, for example, inserts a key into the key switch 35 and rotates the key, thus making it possible to execute operations of the start-up and the stop of the hydraulic excavator 1.

The charge switch 37 is disposed in the cab 6 or the power receiving box 12 in the hydraulic excavator 1, for example. The charge switch 37 is, when the power feeding cable 91 is connected to the power feeding port 12A, a switch for selecting whether or not the electric power of the external power source 92 is supplied to the battery device 11. That is, the charge switch 37 is a switch for selecting whether or not the charging of the battery device 11 is executed. Signals (charge ON signal and charge OFF signal) of the charge switch 37 are inputted to the controller 16. When the power feeding cable 91 is connected to the power feeding port 12A, an operator switches on the charge switch 37, thereby making it possible to execute the charging of the battery device 11.

The locking switch 38 is a detection switch for detecting a position of a gate lock lever (unillustrated). That is, the locking switch 38 detects whether a position of the gate lock lever is a lock position (upper position) for prohibiting a drive of the hydraulic actuator in the hydraulic excavator 1 or a lock releasing position (lower position) for allowing the drive of the hydraulic actuator. Signals of the locking switch 38 (locking signal and lock releasing signal) are outputted to the controller 16. The gate lock lever is operated to an entrance regulating position (lock releasing position) for shutting (closing) a platform of the cab 6 or an entrance allowing position (locking position) for releasing (opening) the platform. The hydraulic excavator 1 can drive the hydraulic actuator while the gate lock lever is operated to the lock releasing position.

The alarm 39 outputs a warning sound and a warning voice to an operator based upon a determination of the controller 16. The alarm 39 is an information alarming device for alarming the information to an operator by the sound.

The rotating speed dial 36 is a dial for variably setting the rotating speed of the electric motor 9. The rotating speed dial 36 is operated by an operator. The rotating speed dial 36 outputs a command (signal) of a motor rotating speed in response to an operation of an operator to the controller 16. The controller 16 controls the inverter 15 by a command of the rotating speed dial. That is, the inverter 15 controls a frequency of the supply voltage to the electric motor 9 by a motor rotating speed command from the controller 16 to control the rotating speed of the electric motor 9.

The hydraulic pump 10 is connected to the electric motor 9. The hydraulic excavator 1 is driven by supply of operating oil discharged from the hydraulic pump 10 via the control valve device to various hydraulic actuators. A quantity of the operating oil discharged from the hydraulic pump 10 corresponds to a rotating speed of the hydraulic pump 10. Therefore, as a rotating speed of the electric motor 9 is the higher, a speed of the hydraulic actuator gets the higher and as the rotating speed of the electric motor 9 is the lower, the speed of the hydraulic actuator gets the lower. In addition, it is possible to stop the hydraulic excavator 1 by stopping the rotation of the electric motor 9.

Incidentally, the automotive construction machine described in Patent Document 1 as mentioned above is provided with a load limiter between the trolley moving along the rail of the ceiling in the working site and the power feeding cable. Therefore, in a case of the technology in Patent Document 1, it is necessary to correct (adjust) a tension detection value of the load limiter or a threshold value used in control or the like depending upon the working site at that time. On the other hand, the hydraulic excavator 1 in the embodiment is provided with the cable load detecting device (overload detecting device) for detecting the load of the power feeding cable 91. In this case, in the embodiment the load detection of the power feeding cable 91 is executed in the cable support device 21 as a support part on the vehicle body side. As a result, in the embodiment the time required for adjustment of the overload detecting device of the power feeding cable 91 depending upon the operating site can be reduced.

That is, according to the embodiment the hydraulic excavator 1 is power-fed via the power feeding cable 91 from the external power source 92. In other words, the hydraulic excavator 1 is charged and driven by the supply power from the exterior of the hydraulic excavator 1. The hydraulic excavator 1 is provided with the power feeding port 12A (cable connection part) to which the power feeding cable 91 is connected, the cable support device 21 for supporting the power feeding cable 91 introduced to the power feeding port 12A, the tension sensor 29 as a load detecting sensor for detecting a load applied to the power feeding cable 91, and the controller 16 as a control device to which the detection value of the tension sensor 29 is inputted. The detection value of the tension sensor 29 corresponds to the load of the power feeding cable 91. The controller 16 limits or controls the drive of the hydraulic excavator 1 based upon the detection value (load) of the tension sensor 29.

Here, the cable support device 21 is supported on the vehicle body to be expansible from the installation position on the vehicle body. That is, the cable support device 21 rotates the arm member 23 to the cable gripping position as shown in FIG. 1 to FIG. 6 from the cab-lateral storage position or the cab-backward storage position, thereby making it possible to expand the tip end side of the arm member 23 from the upper revolving structure 3. The tension sensor 29 detects the load applied to the cable support device 21. That is, the power feeding cable 91 is supported by the cable clamp 26 disposed on the tip end side of the arm member 23. The load of the cable clamp 26 corresponds directly to the load of the power feeding cable 91. The tension sensor 29 detects a tension (changing quantity) of the wire 30 (changing member) corresponding to the load of the cable clamp 26.

As shown in FIG. 5 and FIG. 6, the detection value of the tension sensor 29 is indicated at S and a displacement of the cable clamp 26 from the initial position attached via the spring member 28 to the arm member 23 is indicated at X. The tension of the wire 30 changes in response to the displacement X of the cable clamp 26. That is, the detection value S of the tension sensor 29 has a proportional relationship to the displacement X of the cable clamp 26, and therefore, as the displacement X (displacement X in a direction away from the vehicle body side) of the cable clamp 26 becomes the larger, the tension (detection value S) of the wire 30 becomes the larger. The controller 16, when the tension (detection value S) of the wire 30 goes beyond a prescribed value (first threshold value T1 or second threshold value T2), gives the alarm (warning to an operation and limit to the operating of the hydraulic excavator 1).

In the embodiment a displacement quantity X1 of the cable clamp 26 is defined as a first allowable value, and when the displacement X of the cable clamp 26 is the first allowable value X1, a value of the detection value S of the tension sensor 29 is indicated at T1. In addition, a displacement quantity X2 of the cable clamp 26 is defined as a second allowable value, and when the displacement X of the cable clamp 26 is the second allowable value X2, a value of the detection value S of the tension sensor 29 is indicated at T2. The tension T1 corresponding to the first allowable value X1 is defined as a threshold value (first threshold value T1) on whether to issue an alarm and limit the rotating speed of the electric motor 9. The tension T2 corresponding to the second allowable value X2 is defined as a threshold value (second threshold value T2) on whether to issue an alarm and stop the rotation of the electric motor 9.

When the displacement quantity X of the cable clamp 26 is smaller than X1 ($X<X1$), that is, the detection value S of the tension sensor 29 is smaller than the first threshold value T1 ($S<T1$), the load applied to the power feeding cable 91 is small.

In this case, the controller 16 does not issue the alarm. In addition, the controller 16 does not limit the rotating speed of the electric motor 9. On the other hand, when the displacement quantity X of the cable clamp 26 is equal to or more than X1 and smaller than X2 ($X1 \leq X<X2$), that is, the detection value S of the tension sensor 29 is equal to or more than the first threshold value T1 and smaller than the second threshold value T2 ($T1 \leq S<T2$), the load applied to the power feeding cable 91 is large.

In this case, the controller 16 issues the alarm by the alarm 39 and the monitoring device 34 and limits the rotating speed of the electric motor 9. Further, when the displacement quantity X of the cable clamp 26 is equal to or more than X2 (X2 X), that is, the detection value S of the tension sensor 29 is equal to or more than the second threshold value T2 (T2 S), the load applied to the power feeding cable 91 is further larger. In this case, the controller 16 issues the alarm by the alarm 39 and the monitoring device 34 and stops the rotation of the electric motor 9.

The first threshold value T1 and the second threshold value T2 are in advance found by experiments, calculations, simulations or the like to be capable of suppressing damages of the power feeding cable 91 and the power feeding port 12A. In this case, the first threshold value T1 is determined in a range of 70 to 80% of the maximum allowable tension corresponding to the maximum allowable load of the power feeding cable 91 or the power feeding port 12A, for example, and the second threshold value T2 is determined in a range of 90 to 95% of the maximum allowable tension corresponding to the maximum allowable load of the power feeding cable 91 or the power feeding port 12A, for example.

In the embodiment the load detection of the power feeding cable 91 is executed in a specific section on the vehicle. That is, the load detection of the power feeding cable 91 is executed by detecting a change (change in tension) of the wire 30 between the clamp-side wire support portion 31 and the vehicle body-side wire support portion 32. Therefore, in the embodiment corrections of threshold values and detection values following differences in a length, an installation place and the like of the cable depending upon the working site can be made unnecessary. It should be noted that an explanation will be in detail made later of the control of the alarm in response to the detection value of the tension sensor 29 by the controller 16, that is, the control processing as shown in FIG. 8.

The hydraulic excavator 1 according to the embodiment has the configuration as described above, and next, an explanation will be made of the movement of the hydraulic excavator 1.

For example, in a case where the external power source 92 is in the working site, the power feeding cable 91 extending from the external power source 92 is connected to the power feeding port 12A of the hydraulic excavator 1. Thereby, the electric power from the external power source 92 is supplied via the rectifier 13, the switching device 14 and the inverter 15 to the electric motor 9. The electric power from the external power source 92 is also charged to the battery device 11. The electric motor 9 drives the hydraulic pump 10 by the electric power from the external power source 92 and/or the battery device 11.

Here, at the time of driving the hydraulic excavator 1 by the electric power from the external power source 92, as shown in FIG. 1 to FIG. 6 the hydraulic excavator 1 is operated in a state where the middle part of the power feeding cable 91 is supported by the cable support device 21. That is, an operator operates the traveling lever and pedal at this state, thereby causing the hydraulic excavator 1 to travel. When the operator operates the working lever, the excavating work of earth and sand and the like are carried out by the working mechanism 4 while revolving the upper revolving structure 3. At this time, depending upon an operating direction of the hydraulic excavator 1 and a relation between a length of the power feeding cable 91 and a position of the external power source 92, there is a case where a large force is caused to be applied to the power feeding cable 91. The controller 16 in the hydraulic excavator 1, when the detection value S of the tension sensor 29 goes beyond the prescribed threshold value T1 or threshold value T2, issues the alarm in response to the threshold value T1 or threshold value T2.

Next, an explanation will be made of the control processing to be executed in the controller 16, that is, the control processing for issuing the alarm in response to the detection value S of the tension sensor 29 by referring to FIG. 8. It should be noted that the control processing in FIG. 8 is repeatedly executed in a prescribed control cycle (for example, 10 ms) while power is being supplied to the controller 16, for example.

For example, when the controller 16 is activated by switching on the key switch, the control processing in FIG. 8 is started. The controller 16 reads in the detection value S of the tension sensor 29 at S1. At subsequent S2, the detection value S read in at S1 is compared with the first threshold value T1. That is, it is determined whether or not the detection value S is equal to or more than the first threshold value T1 ($T1 \leq S$). In a case where "YES" determination is made at S2, that is, the detection value S is determined to be equal to or more than the first threshold value T1 (T1≤S), the process goes to S3. At S3, the alarm is switched on. For example, at S3 an alarm is displayed on a display screen of the monitoring device 34 and/or a warning sound and a warning voice are issued by the alarm 39, thereby giving the alarm to an operator.

At S4 subsequent to S3, the rotating speed of the electric motor 9 is limited to a low speed. That is, the controller 16 makes a rotating speed command to the inverter 15 small to lower a drive speed of the hydraulic excavator 1. In this case, the rotating speed of the electric motor 9 is limited to a value to the extent that the load of the power feeding cable 91 or the power feeding port 12A does not abruptly increase even when the drive of the hydraulic excavator 1 continues. For example, the rotating speed of the electric motor 9 is limited to 20 to 50% of the rotating speed set at the rotating speed dial 36.

When at S4, the rotating speed of the electric motor 9 is limited to the low speed, the process goes to S5. At S5, the detection value S read in at S1 is compared with the second threshold value T2. That is, it is determined whether or not the detection value S is equal to or more than the second threshold value T2 (T2 S). In a case where "NO" determination is made at S5, that is, the detection value S is determined to be smaller than the second threshold value T2 (T2>S), the process goes to END. That is, the process goes via END to START, and the processes after S1 are repeated.

On the other hand, in a case where "YES" determination is made at S5, that is, the detection value S is determined to be equal to or more than the second threshold value T2 (T2 S), the process goes to S6. In this case, it can be assumed that the load of the power feeding cable 91 or the power feeding port 12A has reached an allowable value or has exceeded the allowable value. Therefore, at S6 the electric motor 9 is stopped. That is, the controller 16 makes the rotating speed command to the inverter 15 zero to stop the drive of the hydraulic excavator 1. Thereby, as long as the detection value S is not lowered below the second threshold value T2, the drive of the hydraulic excavator 1 is prohibited and the damage of the power feeding cable 91 and the power feeding port 12A is suppressed.

On the other hand, in a case where "NO" determination is made at S2, that is, the detection value S is determined to be smaller than the first threshold value T1 (T1>S), the process goes to S7. At S7, the alarm is switched off. That is, at S7 in a case where the warning is displayed on the display screen of the monitoring device 34, the display is stopped and in a case where the warning sound and the warning voice are outputted by the alarm 39, the output is stopped. At S8 subsequent to S7, the limit of the output of the electric motor 9 is off. That is, at S8 in a case where the rotating speed of the electric motor 9 is limited, the limit is released to return the rotating speed back to the rotating speed set at the rotating speed dial 36. When the limit of the electric motor 9 is released at S8, the process goes via END to START, and the processes after S1 are repeated.

As described above, the hydraulic excavator 1 in the embodiment is provided with the cable clamp 26 as the cable support member, the tension sensor 29 as the load detecting sensor and the controller 16 as the control device. The cable clamp 26 is disposed on the upper revolving structure 3 configuring the vehicle body. The cable clamp 26 supports the power feeding cable 91 connected to the power feeding port 12A. The tension sensor 29 detects a state quantity (tension) corresponding to the load applied to the cable clamp 26 from the power feeding cable 91. The controller 16 issues the alarm when the detection value of the tension sensor 29 (that is, the state quantity detected by the tension sensor 29) goes beyond the prescribed threshold value (threshold value T1 or threshold value T2).

In this way, according to the embodiment the cable clamp 26 for supporting the power feeding cable 91 connected to the power feeding port 12A of the upper revolving structure 3 is disposed on the upper revolving structure 3 configuring the vehicle body. Therefore, it is possible to cause the detection value of the tension sensor 29, that is, the state quantity (tension) corresponding to the load applied to the cable clamp 26 from the power feeding cable 91 to correspond substantially directly to the load applied to the power feeding cable 91. In addition, this corresponding relation does not change substantially even when the operating site changes. Therefore, in any of the operating sites, the threshold value (threshold value T1 or threshold value T2) used in the alarm, that is, the threshold value (threshold value T1 or threshold value T2) used in the process of the alarm for suppressing the damage of the power feeding cable 91 and the power feeding port 12A can be made the same. As a result, it is possible to reduce the time required for the adjustment of the overload detecting device (cable load detecting device) of the power feeding cable 91 in accordance with the operating site.

According to the embodiment, the cable clamp 26 is supported on the upper revolving structure 3 via the arm member 23 as the vehicle body-side support member attached on the upper revolving structure 3. In addition, the tension sensor 29 detects a changing quantity (changing quantity of tension) in response to a displacement of the cable clamp 26 to the arm member 23 as the state quantity. That is, the tension sensor 29 detects a changing quantity (changing quantity of tension) in response to a displacement of the cable clamp 26 to the arm member 23 attached on the upper revolving structure 3. Therefore, based upon the corresponding relation between "a changing quantity in response to a displacement of the cable clamp 26" and "a load applied to the power feeding cable 91", a threshold value for determining whether or not the alarm is given can be set.

According to the embodiment, the end part (tip end) of the arm member 23 extends from the upper revolving structure 3, and the cable clamp 26 is supported to be capable of being displaced on the end part (tip end) of the arm member 23. That is, the cable clamp 26 is supported to be capable of being displaced on the end part (tip end) of the arm member 23 as a portion extended (projected portion) from the upper revolving structure 3. Therefore, for example, a distance between a part, which is supported (gripped) by the cable clamp 26, of the power feeding cable 91 and the power feeding port 12A can be made long to improve a degree of freedom in handling the power feeding cable 91. In addition, since the power feeding cable 91 is supported on the part extended from the upper revolving structure 3, it is possible to further reduce a possibility that the power feeding cable 91 is stepped on by the lower traveling structure 2 and a possibility that the power feeding cable 91 is caught up following the revolving of the upper revolving structure 3.

According to the embodiment, the guide member (not shown) is disposed between the cable clamp 26 and the arm member 23 (bracket 27) to regulate a direction where the cable clamp 26 is displaced to the arm member 23 (bracket 27). In addition, the spring member 28 is disposed between the cable clamp 26 and the arm member 23 (bracket 27) as an elastic member that is elastically deformed following the displacement of the cable clamp 26. Therefore, the direction of the displacement of the cable clamp 26 can be regulated and the cable clamp 26 can be suppressed from being largely displaced although the load applied to the power feeding cable 91 is small. Thereby, it is possible to accurately acquire the corresponding relation between "a changing quantity in response to a displacement of the cable clamp 26 to the arm member 23" and "a load applied to the power feeding cable 91". Along with this, although the load applied to the power feeding cable 91 is small, the controller 16 can be suppressed from issuing the alarm. Thereby, the unnecessary alarm of the controller 16 can be suppressed to improve the accuracy of the alarm.

According to the embodiment, there is provided the changing member that changes in response to a displacement of the cable clamp 26 to the arm member 23. Besides, the tension sensor 29 as the load detecting sensor detects a changing quantity (tension) of the wire 30 as the changing member. Therefore, based upon the corresponding relation between "a changing quantity (tension) of the wire 30" and "a load applied to the power feeding cable 91", a threshold value for determining whether or not the alarm is issued can be set.

According to the embodiment, the wire 30 as the changing member is fixed on both of the vehicle body side (vehicle body-side wire support portion 32) and the cable clamp 26-side (vehicle body-side wire support portion 32). In addition, the tension sensor 29 detects a load applied to the wire 30 as a state quantity. That is, the tension sensor 29 detects a load (tension) applied to the wire 30 fixed on both of the vehicle body side (vehicle body-side wire support portion 32) and the cable clamp 26-side (vehicle body-side wire support portion 32). Therefore, based upon the corresponding relation between "a load (tension) applied to the wire 30" and "a load applied to the power feeding cable 91", a threshold value for determining whether or not the alarm is given can be set.

More specifically, according to the embodiment, the wire 30 is adopted as the changing member that changes in response to the displacement of the cable clamp 26 to the arm member 23. The wire 30 is bridged over between the vehicle body side (vehicle body-side wire support portion 32) and the cable clamp 26-side (vehicle body-side wire support portion 32). The wire 30 changes in tension in response to the displacement of the cable clamp 26. The tension sensor 29 detects the tension of the wire 30. Therefore, based upon the corresponding relation between "the tension of the wire 30" and "the load applied to the power feeding cable 91", the threshold value for determining whether or not the alarm is given can be set.

According to the embodiment, the controller 16 issues a warning sound from the alarm 39 and/or displays a warning on the screen of the monitoring device 34 as the monitor, thereby issuing the alarm. In addition thereto, the controller 16 issues the alarm by limiting the movement of the hydraulic excavator 1 (limiting the rotation of the electric motor 9). Therefore, based upon the alarm of the controller 16, an operator can execute necessary operations (operations for limiting the movement). In addition, based upon the alarm of the controller 16, the movement of the hydraulic excavator 1 is automatically limited (the electric motor 9, consequently the output of the hydraulic pump 10 is limited). Thereby, the damage of the power feeding cable 91 can be suppressed. It should be noted that the controller 16 may issue an alarm by turning on a warning light disposed in the cab 6. That is, the controller 16 executes warning sounds, warning lights, and warning displays on the monitor as alarm methods or carries out the limit of the movement.

In any case, according to the embodiment the positional relation of the shaft member 22 fixed on the upper revolving structure 3, the arm member 23, the cable clamp 26, the spring member 28 and the wire 30 does not almost change even when the operating site changes. In addition, the controller 16 determines a magnitude of the load of the power feeding cable 91 by using the detection value S of the tension sensor 29 in response to the displacement quantity of the cable clamp 26. Therefore, the threshold values T1, T2 for determining a magnitude of the load of the power feeding cable 91 may not be corrected. That is, the time required for adjustment of the threshold values T1, T2 in accordance with the operating site can be reduced to facilitate the control (movement control) for protecting the power feeding cable 91.

It should be noted that in the embodiment, a case where the wire 30 is defined as the changing member that changes in response to the displacement of the cable clamp 26 to the arm member 23 and the tension sensor 29 is defined as the load detecting sensor for detecting a changing quantity (load) in response to the displacement of the cable clamp 26 to the arm member 23 is explained as an example. However, not limited thereto, for example, the changing member may be a spring member disposed between an arm member (vehicle body-side support member) and a cable clamp (cable support member), and the load detecting sensor may be a load sensor, that is, a load sensor for detecting a load applied to the spring member. In addition, a displacement sensor for detecting a length of the spring member may be used as the load detecting sensor.

In the embodiment, a case where the changing member (wire 30) that changes in response to the displacement of the cable clamp 26 to the arm member 23 is disposed is explained as an example. However, not limited thereto, a displacement sensor that detects a displacement of a cable clamp (cable support member) to an arm member (vehicle body-side support member) may be disposed as the load detecting sensor without disposing the displacement member (with the displacement member being omitted), for example. Further, a load sensor as the load detecting sensor may be disposed between an arm member (vehicle body-side support member) and a cable clamp (cable support member), wherein the load sensor may detect a load (state quantity) applied between the arm member (vehicle body-side support member) and the cable clamp (cable support member). The state quantity detected by the load detecting sensor may be a state quantity corresponding to a load applied to the cable clamp (cable support member) via a power feeding cable and, not limited to the displacement and the load, a state quantity other than these may be used.

In the embodiment, a case where two threshold values T1, T2 are set and in a case of going beyond the threshold value T1, the alarm by the warning and the alarm by the limit of the movement of the hydraulic excavator 1 are issued and in a case of going beyond the threshold value T2 greater than the threshold value T1, the alarm by the warning and the alarm by the stop of the movement of the hydraulic excavator 1 are issued is explained as an example. However, not limited thereto, for example, in a case of going beyond the threshold value T1, the alarm by the warning may be issued, in a case of going beyond the threshold value T2 greater than the threshold value T1, the alarm by the limit of the movement of the hydraulic excavator 1 may be issued and in a case of going beyond the threshold value T3 greater than the threshold value T2, the alarm by the stop of the movement of the hydraulic excavator 1 may be issued. In addition, a single threshold value is given, and when the load of the power feeding cable goes beyond this single threshold value, the alarm by the stop of the movement of the hydraulic excavator 1 may be issued. "Threshold value" and "alarm" at the time of going beyond the threshold value can be set (selected) to be capable of suppressing damages of the power feeding cable and the power feeding port.

In the embodiment, the hydraulic excavator 1 provided with the swing type working mechanism 4 is explained as an example. However, not limited thereto, for example, the present invention may be applied to a hydraulic excavator provided with the other type working mechanism (front device), for example, a hydraulic excavator provided with a mono-boom type working mechanism, a hydraulic excavator provided with an offset type working mechanism, and the like. In addition, a case where the bucket 4D is used as the working tool of the working mechanism 4 is explained as an example, but for example, a working mechanism provided with the other working tool of a mill or the like may be used.

In the embodiment, the hydraulic excavator 1 in which the battery device 11 is mounted on the upper revolving structure 3 is explained as an example. That is, in the embodiment the electric hydraulic excavator 1 in which the electric motor 9 is driven by the electric power from the external power source 92 and is also driven by the electric power charged in the battery device 11 is explained as an example. However, not limited thereto, there may be used an electric construction machine in which an electric motor is driven only by the electric power from an external power source with the battery device being not mounted, for example.

In the embodiment the hydraulic excavator 1 of a cab specification provided with the cab 6 is explained as an example. However, not limited thereto, a hydraulic excavator of a canopy specification may be used, for example.

In the embodiment the compact hydraulic excavator 1 is explained as an example, but the present invention may be applied to a midsize hydraulic excavator or a hydraulic excavator larger than the midsize one, for example. In addition, a case where the vehicle body includes the lower traveling structure 2 and the upper revolving structure 3 is explained as an example, but there may be used a vehicle body not having a revolving body (for example, an articulate type vehicle body in which a front vehicle body having front wheels and a rear vehicle body having rear wheels are connected via a connecting shaft to be capable of bending).

In the embodiment the hydraulic excavator 1 is explained as the construction machine as an example, but not limited thereto, the present invention may be applied widely to various construction machines of wheel loaders, fork lifts, tractors, combines.

DESCRIPTION OF REFERENCE NUMERALS

1: ELECTRIC HYDRAULIC EXCAVATOR (ELECTRIC CONSTRUCTION MACHINE)
2: LOWER TRAVELING STRUCTURE (VEHICLE BODY)
3: UPPER REVOLVING STRUCTURE (VEHICLE BODY)
4: WORKING MECHANISM
9: ELECTRIC MOTOR (POWER SOURCE)
12A: POWER FEEDING PORT
16: CONTROLLER
23: ARM MEMBER (VEHICLE BODY-SIDE SUPPORT MEMBER)
26: CABLE CLAMP (CABLE SUPPORT MEMBER)
28: SPRING MEMBER (ELASTIC MEMBER)
29: TENSION SENSOR (LOAD DETECTING SENSOR)
30: WIRE (CHANGING MEMBER)
34: MONITORING DEVICE (MONITOR)
39: ALARM
91: POWER FEEDING CABLE

The invention claimed is:

1. An electric construction machine comprising:

a vehicle body having an automotive lower traveling structure and an upper revolving structure rotatably mounted on the lower traveling structure, and a working mechanism attached to a front side of the upper revolving structure and a counterweight attached to the rear side of the upper revolving structure, the upper revolving structure being provided with a power feeding port for connection of a power feeding cable that supplies electric power to a power source, wherein:

the electric construction machine further comprise a cable support member that is disposed to be capable of being displaced in a vehicle body-side support member attached to the upper revolving structure to grip the power feeding cable connected to the power feeding port;

a guide member that is disposed between the cable support member and the vehicle body-side support member to regulate a linear displacement of the cable support member to the vehicle body-side support member a horizontal direction;

a load detecting sensor for detecting a changing quantity in response to the displacement of the cable support member to the vehicle body-side support member; and a controller configured to issue an alarm when a detection value of the load detecting sensor goes beyond a prescribed threshold value, wherein the vehicle body-side support member has an end part that extends to the outside of the upper revolving structure further outward than a rear surface of the counterweight, and the cable support member is supported on the end part of the vehicle body-side support member via the guide member so as to be capable of being displaced only in a horizontal direction and not to be capable of being displaced in a vertical direction.

2. The electric construction machine according to claim 1, further comprising:

a cab attached to the upper revolving structure, and a shaft member disposed between the upper revolving structure and the vehicle body-side support member and attached to the vehicle body in a state where a shaft center thereof is extending in the upper-lower direction, wherein the vehicle body-side support member is attached to the shaft member to be capable of rotating centering on the shaft center in the upper-lower direction of the shaft member and can be fixed in a plurality of positions, and the plurality of positions fixed the vehicle body-side support member includes a cable gripping position which the end part of the vehicle body-side support member extends to the outside of the upper revolving structure further outward than a rear surface of the counterweight, and a storage position which the vehicle body-side support member is arranged along the right side surface of the cab or the rear surface of the cab.

3. The electric construction machine according to claim 1, further comprising:

an elastic member that is elastically deformed following the displacement of the cable support member.

4. The electric construction machine according to claim 1, further comprising:

a changing member that changes in response to the displacement of the cable support member to the vehicle body-side support member, wherein the changing member is fixed on both of the vehicle body side and the cable support member side, and the load detecting sensor detects a load applied to the changing member as the changing quantity.

5. The electric construction machine according to claim 1, further comprising:

a changing member that changes in response to the displacement of the cable support member to the vehicle body-side support member, wherein the changing member includes a wire that is bridged over between the vehicle body side and the cable support member side, and the load detecting sensor detects a tension of the wire as the changing quantity.

6. The electric construction machine according to claim 1, wherein the controller, as methods of the alarm, gives a warning sound, a warning light, a warning display on a monitor, or executes a limit of movement.

* * * * *